US011352804B2

(12) United States Patent
Pate

(10) Patent No.: US 11,352,804 B2
(45) Date of Patent: Jun. 7, 2022

(54) DEBRIS BARRIER FOR SWIMMING POOL CIRCULATION SYSTEM

(71) Applicant: John W. Pate, Grapevine, TX (US)

(72) Inventor: John W. Pate, Grapevine, TX (US)

( * ) Notice: Subject to any disclaimer, the term of this patent is extended or adjusted under 35 U.S.C. 154(b) by 0 days.

(21) Appl. No.: 16/932,251

(22) Filed: Jul. 17, 2020

(65) Prior Publication Data

US 2022/0018148 A1 Jan. 20, 2022

(51) Int. Cl.
*E04H 4/14* (2006.01)
*E04H 4/12* (2006.01)

(52) U.S. Cl.
CPC ..... *E04H 4/14* (2013.01); *E04H 4/1272* (2013.01)

(58) Field of Classification Search
CPC ..... E04H 4/14
USPC ..... 4/496, 488, 497, 505; 482/55; 405/27
See application file for complete search history.

(56) References Cited

U.S. PATENT DOCUMENTS 4,369,109 A * 1/1983 Edge ..... B01D 29/96 210/167.19
5,139,660 A * 8/1992 Lourie ..... E04H 4/1609 15/1.7
5,510,020 A * 4/1996 Gronlund ..... E04H 4/1254 210/167.18
5,753,112 A * 5/1998 Barnes ..... B01D 29/117 210/167.12
6,041,453 A * 3/2000 Barrow ..... E04H 4/1263 137/115.13
6,604,254 B1 * 8/2003 Powell ..... A46B 11/063 15/1.7
7,195,708 B2 * 3/2007 Mullner, Jr. ..... E04H 4/1272 210/167.19
7,374,671 B2 * 5/2008 Blake ..... E04H 4/1254 210/167.19
7,392,909 B1 * 7/2008 Conrad ..... E04H 4/1609 210/232
7,594,997 B1 * 9/2009 Kazarian ..... E04H 4/1254 210/167.19
7,909,991 B2 * 3/2011 Hernandez ..... E04H 4/1254 210/167.19
8,650,807 B2 * 2/2014 McKimmy ..... E04B 1/34321 52/79.9
10,006,213 B2 * 6/2018 Keeler ..... E04H 4/1272
10,138,644 B1 * 11/2018 Piepenburg ..... B01D 29/27
10,876,313 B1 * 12/2020 Schmidt ..... E04H 4/1272
2009/0165201 A1 * 7/2009 Vultaggio ..... E04H 4/0062 4/506
2010/0089842 A1 * 4/2010 Hernandez ..... E04H 4/1254 210/776
2011/0281496 A1 * 11/2011 Welsh ..... A63H 33/008 446/487

(Continued)

*Primary Examiner* — Lori L Baker
(74) *Attorney, Agent, or Firm* — Warren Norred

(57) ABSTRACT

A portable barrier apparatus for preventing leaves and debris from entering a pool filtration system and may include a front panel; a first angled panel connected to the front panel; a second angled panel opposing the first angled panel and connected to the front panel; and a top panel connected to the front panel, the first angled panel and the second angled panel, extending beyond the first angled panel and the second angled panel. The barrier allows for water to be filtered through the underside of the barrier and keeps debris from entering the pool filtration system.

6 Claims, 13 Drawing Sheets

(56) References Cited

U.S. PATENT DOCUMENTS

| | | | | |
|---|---|---|---|---|
| 2013/0186812 | A1* | 7/2013 | Fitzpatrick | E04H 4/1272 210/167.19 |
| 2016/0010352 | A1* | 1/2016 | Lafontaine | E04H 4/1272 4/490 |
| 2016/0251866 | A1* | 9/2016 | Greenwald | E04H 4/1272 210/167.19 |
| 2017/0121994 | A1* | 5/2017 | Keeler | E04H 4/1272 |

* cited by examiner

DEBRIS BARRIER FOR SWIMMING POOL CIRCULATION SYSTEM

FIELD OF THE INVENTION

The present invention relates to pool filters and more particularly to a debris barrier to protect pool equipment.

BACKGROUND

Swimming pools allow users to enjoy a hot day in cool water, keeping the swimming pool clean allows for safe, hygienic, and comfortable use of the swimming pool. Swimming pools are not immune from becoming dirty; leaves, insects, and other debris are bound to fall into the pool and must be cleaned out overtime. Most swimming pools include certain cleaning systems to filter debris and keep the water clean. Pool re-circulating filters remove the majority of small suspended materials. The same re-circulating pump is used as part of a vacuum system to remove the larger materials that are deposited on the pool bottom and sides. A swimming pool water circulation system includes the pool itself, a motor driven pump, a flow duct from the pool to the inlet or suction side of the pump, a return flow duct from the discharge or pressure side of the pump to the pool, and a system filter unit in the return flow duct. If desired, a water heater can be installed in the return duct. The system filter is of the kind which removes sand, dust and other finely divided solid matter from water passed through it; many system filters use a diatomaceous earth filtering medium. System filters are not well suited for the removal from water of larger things such as leaves, flower petals, pine needles and the like. A flexible hose attached to the skimmer intake at one end extends to a vacuum head at the other; upon activation of the pool pump the latter is maneuvered over the pool side and bottom surfaces to retrieve water-soaked leaves, branches, and grass and other low density materials found resting thereon, resulting in water entrainment that carries the debris through the flexible hose for return to the pool pump. A pre-filter is usually employed at an in-line position along the flexible hose, separating out the larger particles to prevent premature fouling of the pool filter (and pool pump), which is designed for use in separating out the finer particles of soil and silt from the re-circulating pool water. The leaves and larger particles may cause the filter, prefilter and pool pump to clog due to the accumulation of the leaves and larger articles. Without water flowing through the filter, prefilter, and pool pump, the water may be denied the benefits of circulation, which in wintertime may cause the water to freeze resulting in damage to the pool and expensive repairs. Swimming pool cleaning has received much attention in the last few decades and automated pool cleaners are well established, powered by water that is circulated by a pump that is installed at the pool. These cleaners clean the bottom and side walls of the pool below water level to a greater or lesser extent. Suction type pool bottom cleaners are connected at the pool weir but their effectiveness is steadily reduced as debris accumulates in the leaf basket that is located in the skimmer. This type of arrangement is subject to the same disadvantages as described above.

Pool cleaning devices which operate on pump suction are also known; they include vacuum heads which are coupled to long poles and are moved manually across the pool bottom, and they also include automatic devices which move across the pool bottom the former are used for short periods, whereas the latter can be operated for long periods measured in hours or days. Such devices are coupled by flexible suction hoses to the circulation pump inlet via the pool skimmer or a wall outlet; they operate to vacuum accumulations of dirt, leaves, and the like from the bottom of the pool, allowing the pool pump and filter to remove them.

SUMMARY OF THE INVENTION

The present invention comprises a barrier for preventing leaves and large debris from entering a pool filtration system and may include a front panel; a first angled panel connected to the front panel; a second angled panel opposing the first angled panel and connected to the front panel; and a top base connected to the front panel, the first angled panel and the second angled panel, extending beyond the first angled panel and the second angled panel. The base is placed above the skimmer water filtration inlets to allow the panels hang over and surround the skimmer filtration inlet. The barrier allows water to circulate into the skimmer from the bottom while blocking all debris. The debris will become waterlocked and sink to the bottom of the pool to be cleaned by the filtration system.

Figure 7:
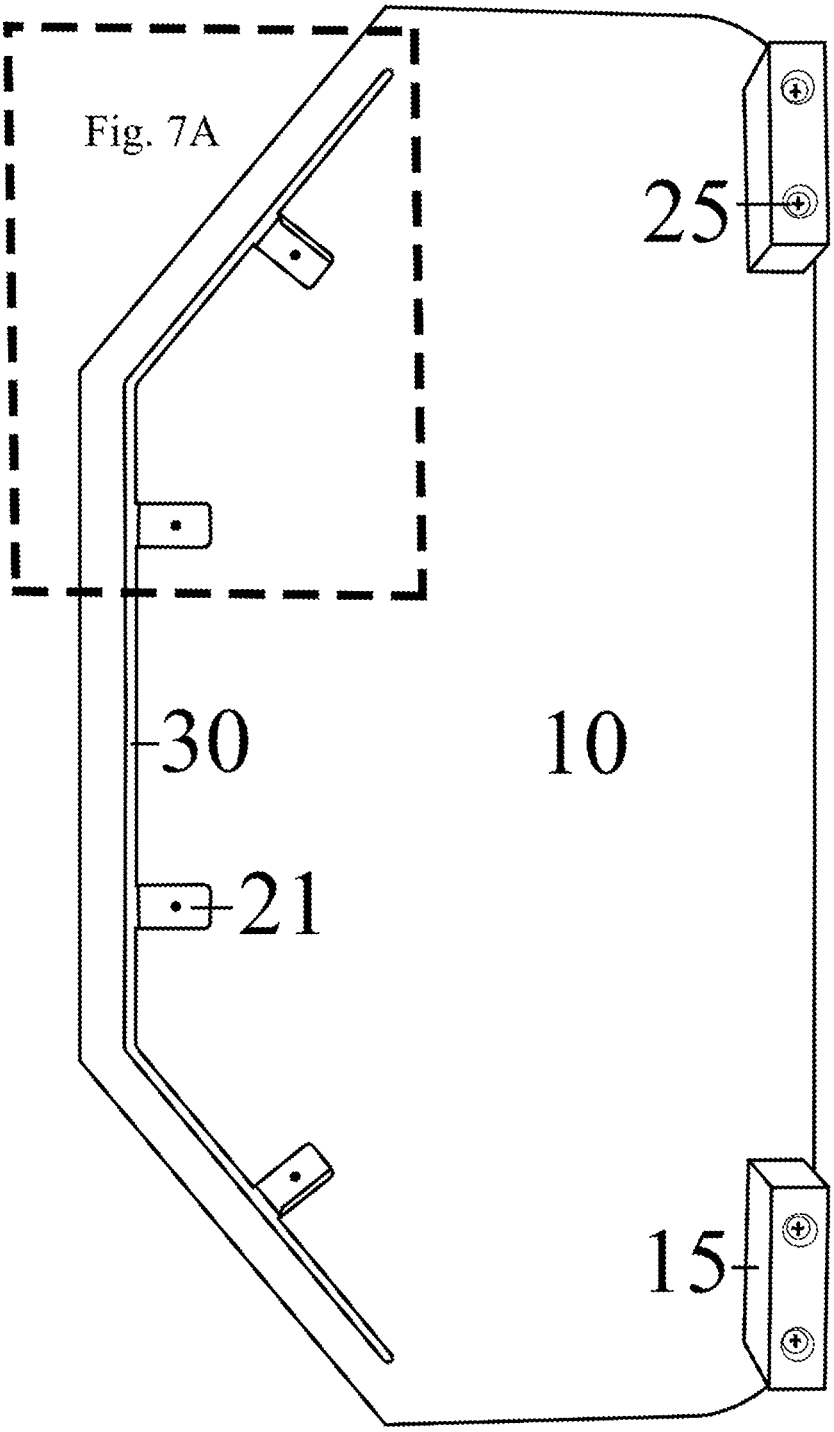
FIG. 7 is a bottom view of the base 10 according to various embodiments of the present invention. The rectangular section indicated by "A" approximates the perspective view shown in FIG. 7A.
Figure 7A:
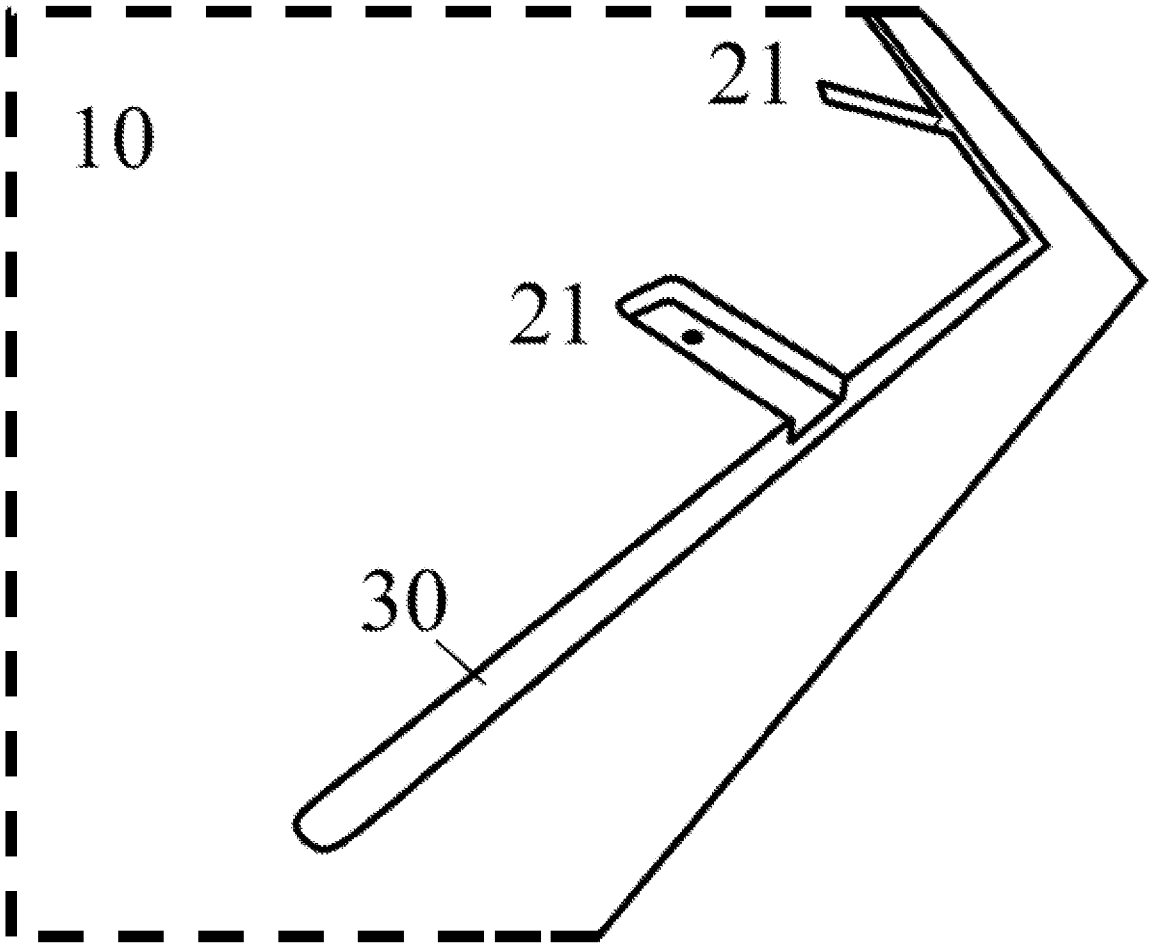
FIG. 7A is a perspective close view of the panel slot 30 according to various embodiments of the present invention as indicated in FIG. 7 by the rectangular section indicated at A, FIG. 7.
Figure 8:
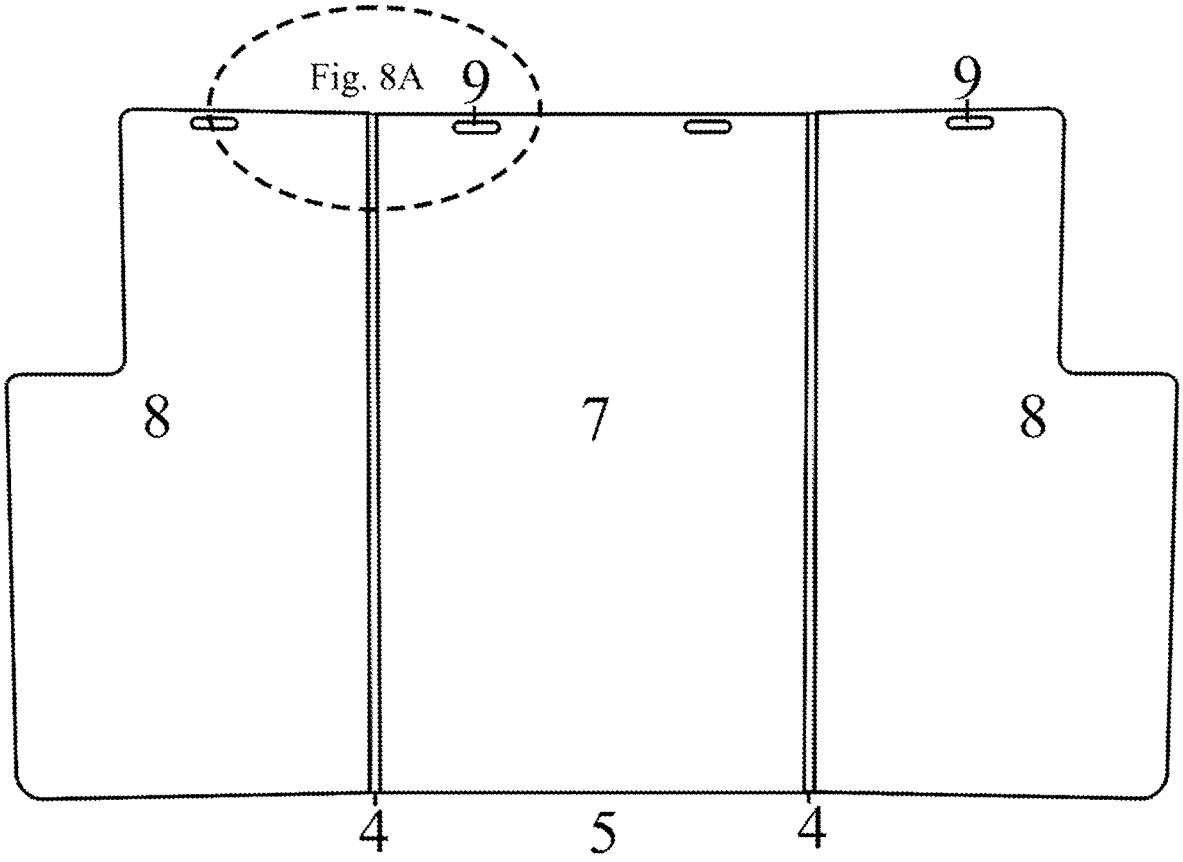
FIG. 8 is a top view of the panel 5 according to various embodiments of the present invention. The area indicated by the dotted oval shape shows the perspective view shown in FIG. 8A.
Figure 8A:
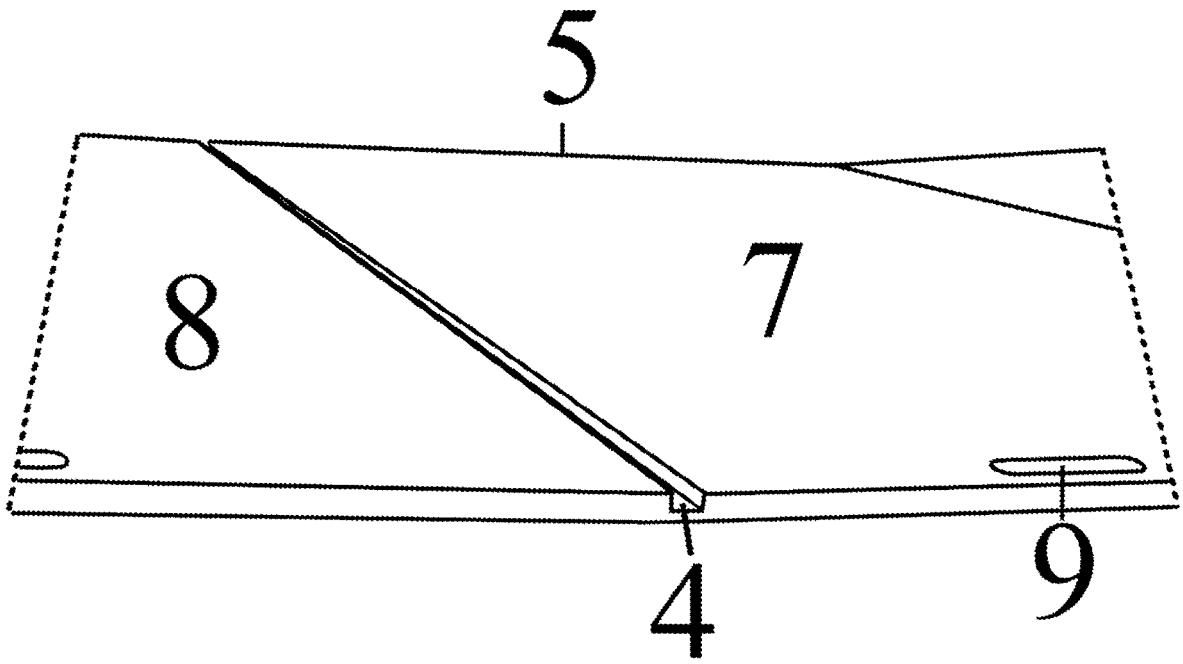
FIG. 8A is a close perspective view of a front panel 7 and a side panel 8 as indicated in FIG. 8.

In both FIG. 7A and FIG. 8A, the goal is to show the detail of the indicated elements. Both of these figures are from the indicated area of the previous figure, raised to allow the viewer to see a perspective view. The dotted lines indicate that the view does not capture the entirety of the bottom of the base 10 shown in FIG. 7A or the panels shown in FIG. 8A.

Figure 9:
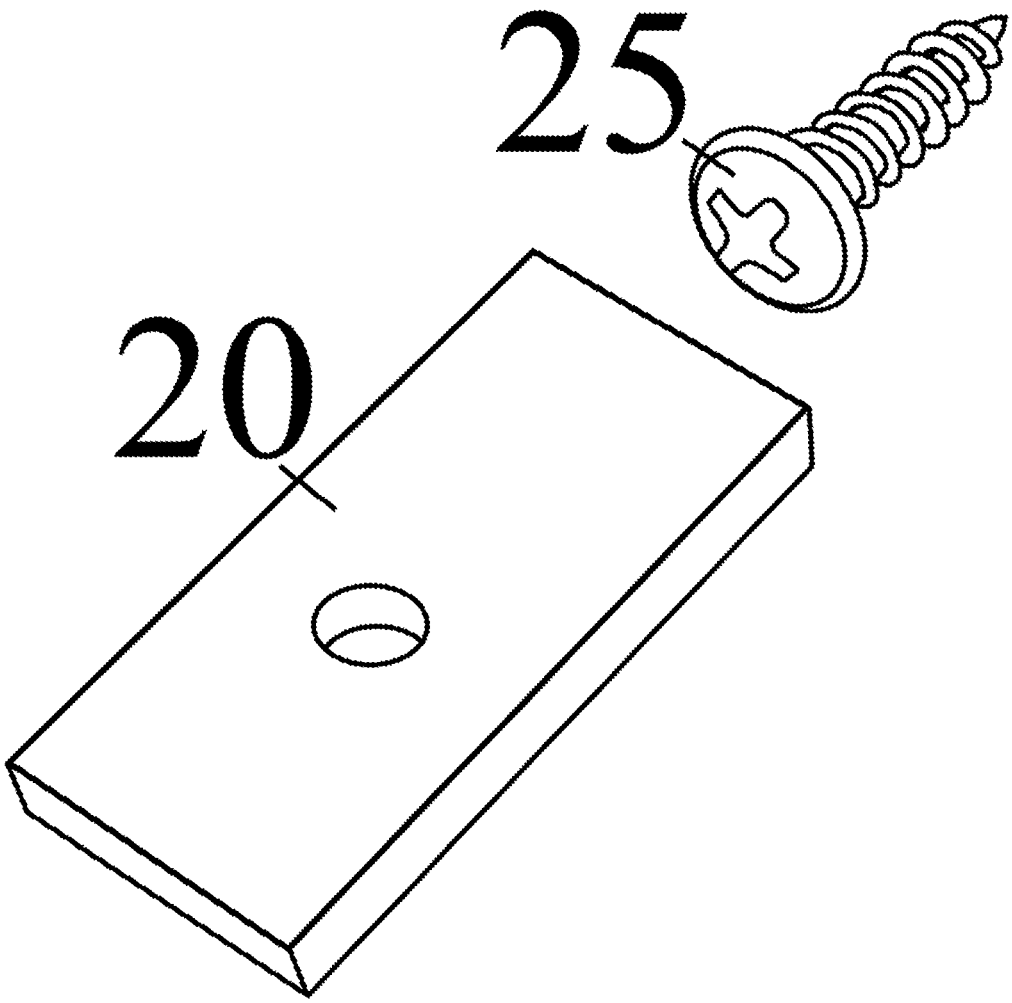

FIG. 9 shows an orthogonal view of an insert 20 and a screw 25 according to various embodiments of the present invention.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise. It will be further understood that the terms "comprises" and "comprising", when used herein, specify the non-limiting presence of stated features, steps, operations, elements, or components, not precluding other like limitations.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A novel debris barrier for swimming pool filtration systems is disclosed herein. In the following description, for purposes of explanation, numerous specific details are set forth in order to provide a thorough understanding of the present invention. It will be evident to one skilled in the art that the present invention may be practiced without these details.

The present disclosure is to be considered as an exemplification of the invention, and is not intended to limit the invention to the specific embodiments illustrated by the figures or description below.

The present invention prevents leaves and other floating debris which may be floating near or at the surface of the pool water from entering the filtration system and clogging the device for filtering the pool water and consequently, allows the water to flow past the heater preventing the pool from freezing when the outside temperature is below the freezing level. This device also prevents clogging of the circulation system in the, fall, winter and spring seasons, when larger debris enters the pool from harsh weather. The present invention provides a cavity which may facilitate the flow of water to the filter by an open bottom which may be several inches below the surface level of the water. Furthermore, the debris barrier may be movable and relocatable to different locations.

Figure 1:
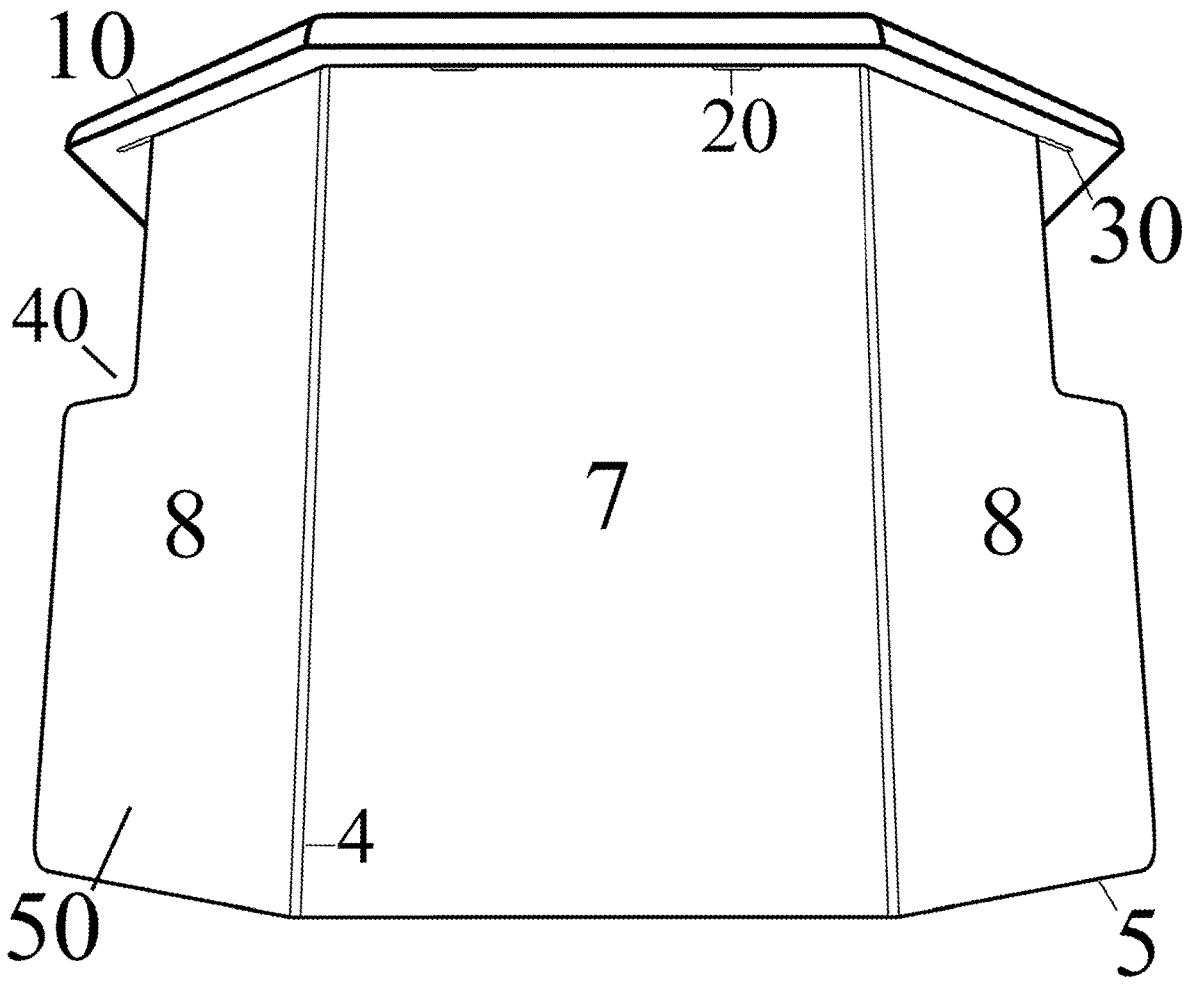
FIG. 1 is a front view of the debris barrier according to various embodiments of the present invention.

The present invention will now be described by referencing the appended figures representing preferred embodiments. FIG. 1 is a front view of the debris barrier according to various embodiments of the present invention. The Panel 5 consists of flat material with partitions dividing the panel into a front panel 7 and side panels 8. Panel 5 is composed of a front panel 7 and side panels 8 with a panel bend 4 between the front panel 7 and side panels 8. Panel 5 is attached to the bottom of the base 10 by being secured into the panel slot 30 with several inserts 20 with screws 25. The base 10 is placed above an inlet for the pool filtration system with the panel 5 hanging over the lip of the pool structure surrounding the entrance to a water intake. The panel 5 features indentions 40 on each side panels 8 to compensate for any pool rim. As used throughout this application, a reference to a water intake is not limited to one used for filtration but one that can be used only for circulation—the point is to ensure that debris remains in the pool and does not enter the circulation system.

Figure 2:
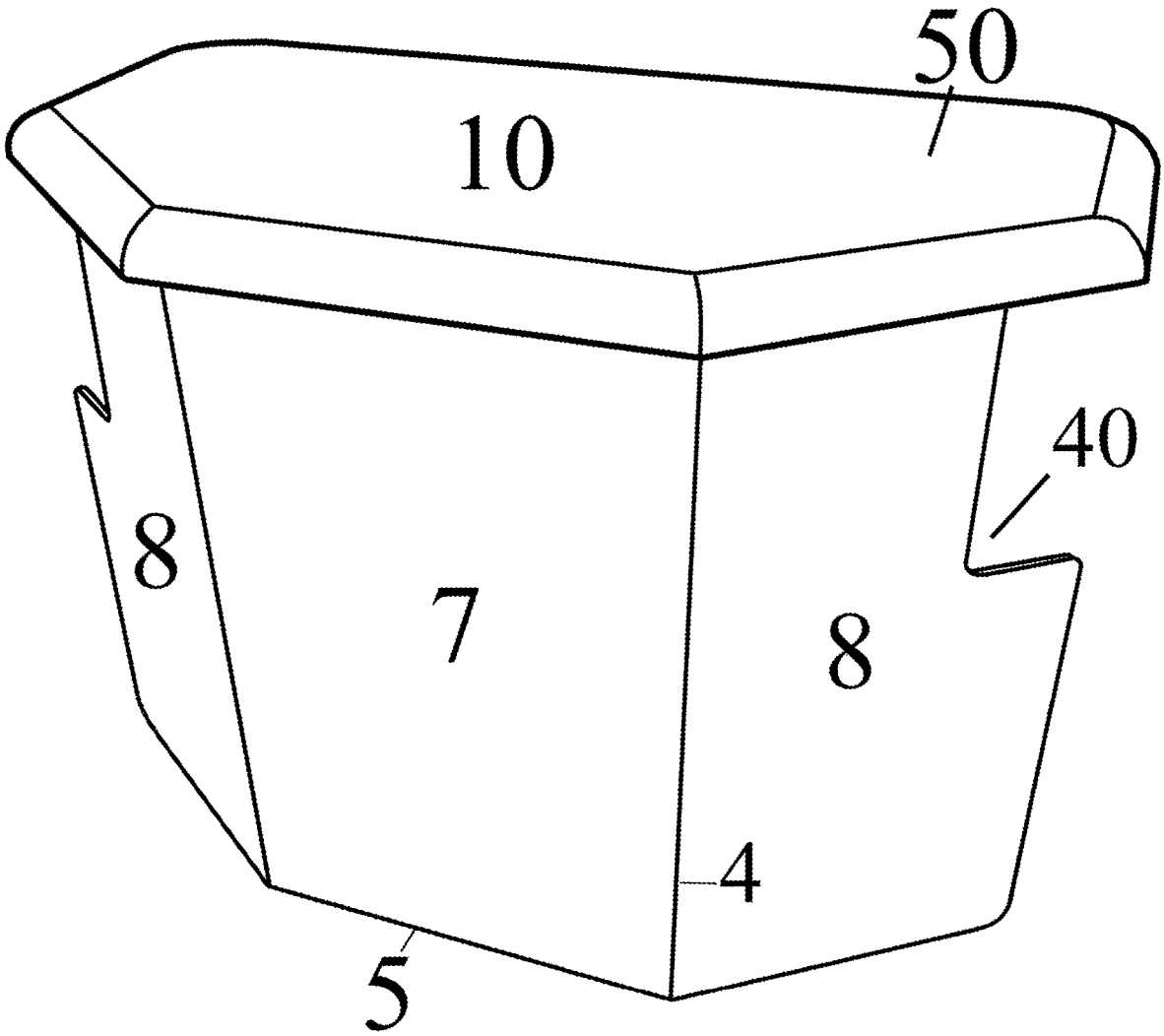
FIG. 2 is a perspective view of the debris barrier according to various embodiments of the present invention.

FIG. 2 is an orthogonal view of the debris barrier according to various embodiments of the invention. The base 10 is placed over the edge of a pool wall for the panel 5 to cover the water intake. The panel 5 features indentions 40 on each side panels 8 to compensate for any pool rim. The front panel features panel bends 4 connecting the side panels 8 to create a barrier between the floating debris and the water circulation system. The debris will be waterlocked and sink to the bottom of the pool to be cleaned by the pool filtration system.

Figure 3:
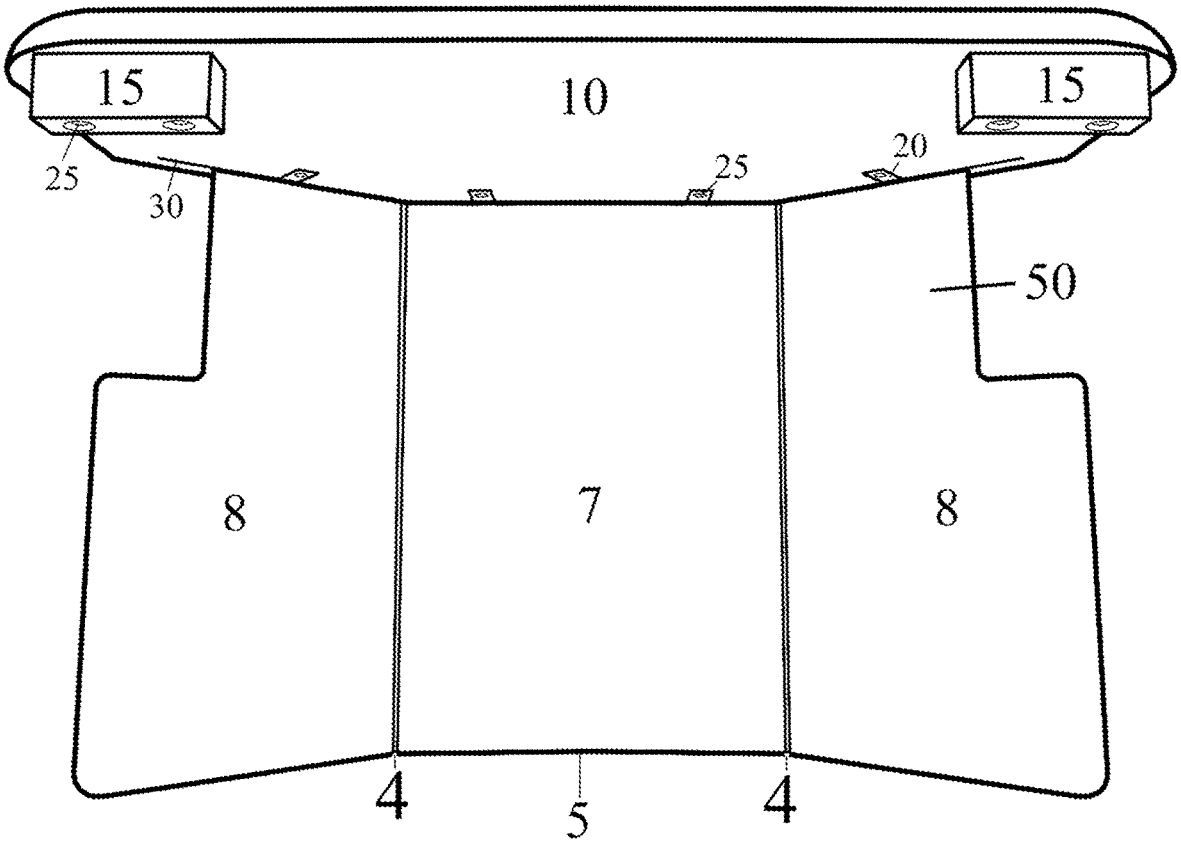
FIG. 3 is a rear view of the debris barrier according to various embodiments of the present invention.
Figure 3A:
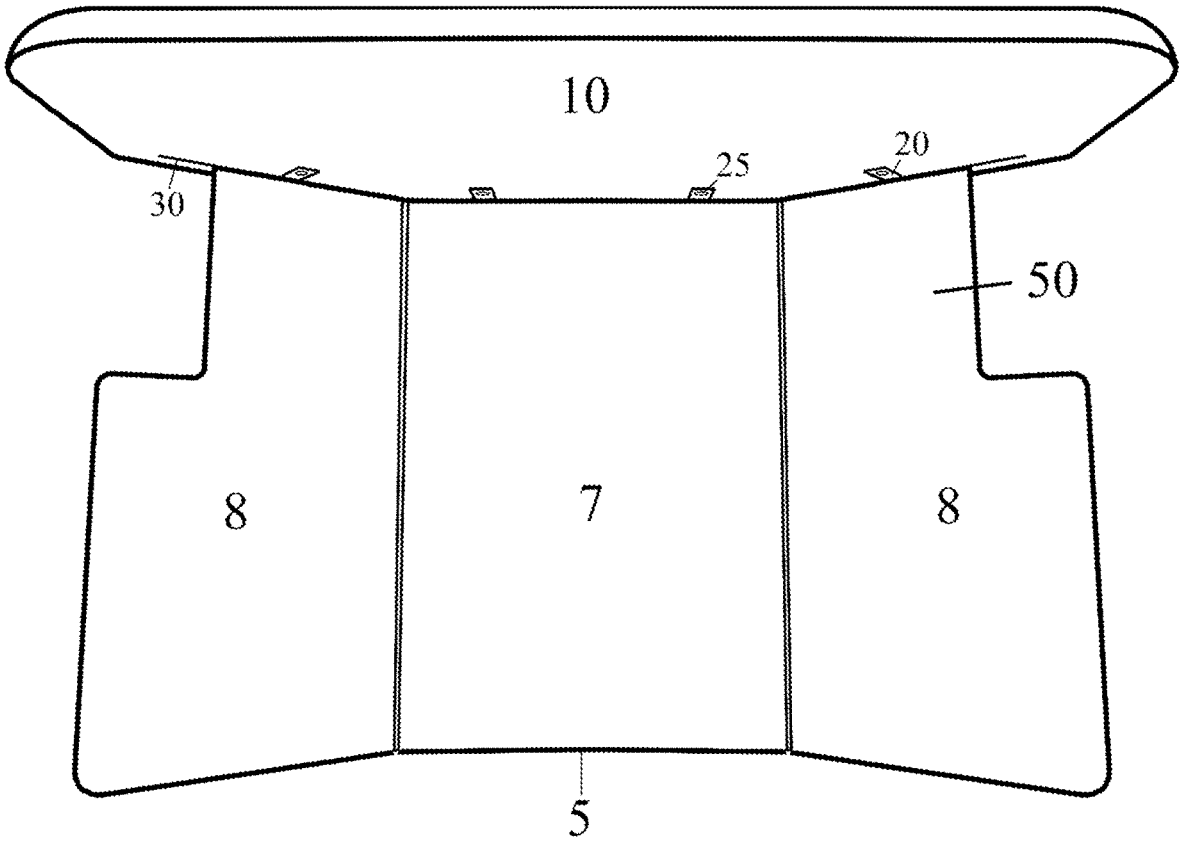
FIG. 3A is a rear view of the debris barrier without the optional stand blocks according to various embodiments of the present invention.

FIG. 3 is a rear view of the debris barrier according to various embodiments of the present invention. The base 10 features stand-blocks 15 attached to the base 10 by screws 25 to help secure the debris barrier 50 to the side of the pool wall. The panel 5 is formed to the panel slot 30 by folding the panel bends 4 and securing the panel 5 to the base with inserts 20 threaded through the panel holes 9 that use screws 25 to attach into the base 10. The panel 5 features side panels 8 to surround the water intake.

Figure 4:
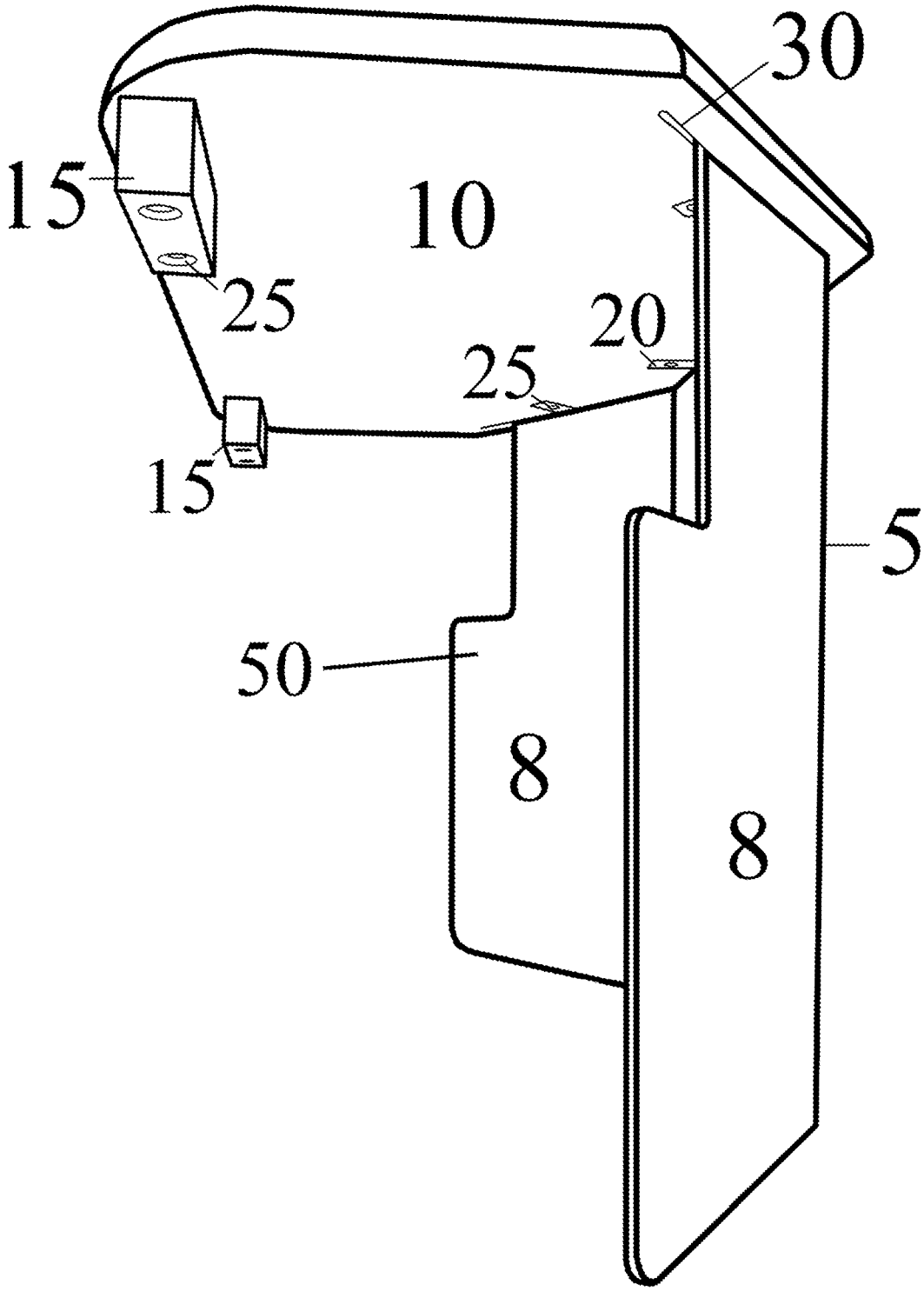
FIG. 4 is a side view of the debris barrier according to various embodiments of the present invention.
Figure 4A:
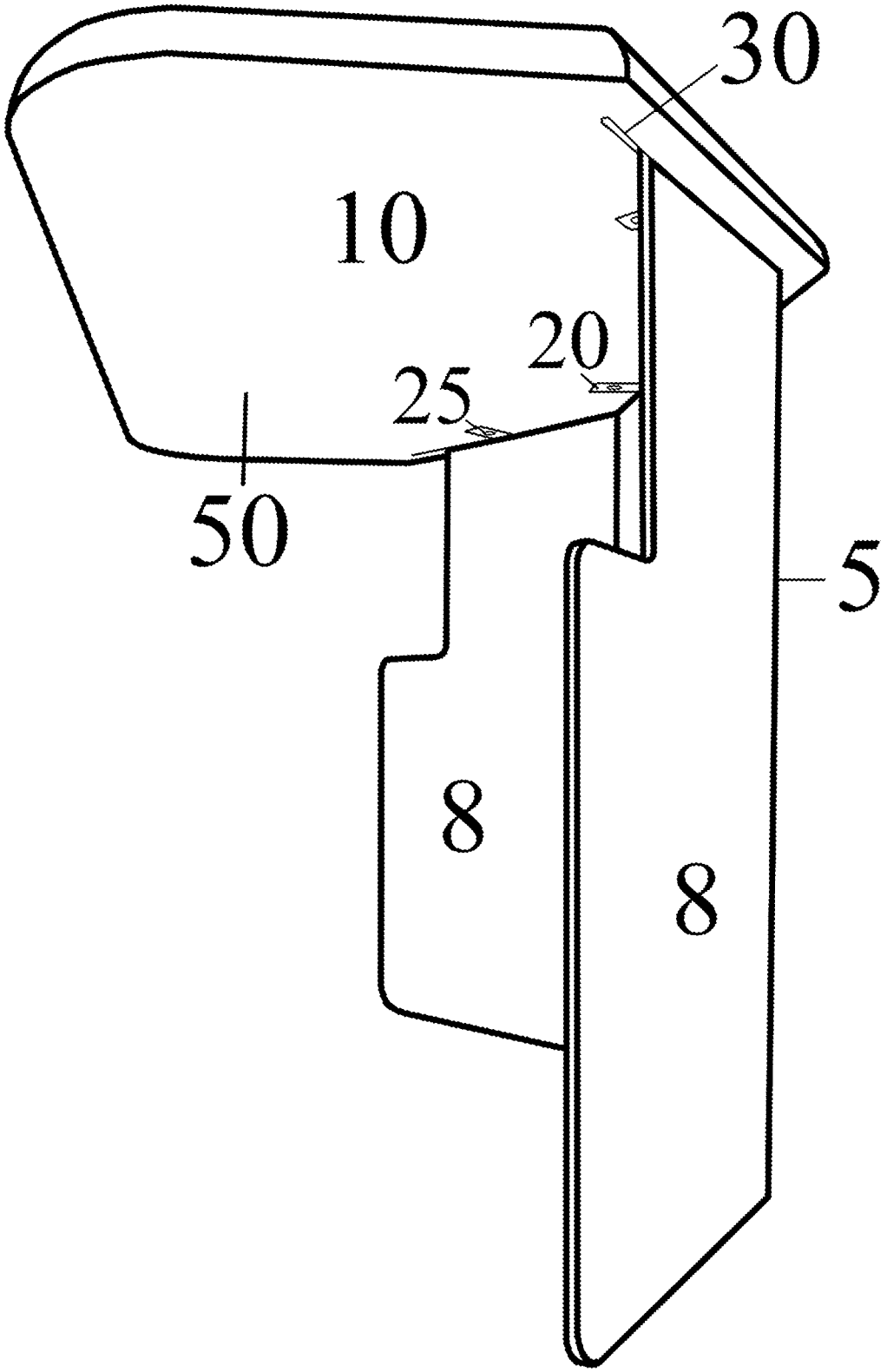
FIG. 4A is a side view of the debris barrier without the optional stand blocks according to various embodiments of the present invention.

FIG. 4 is a side view of the debris barrier according to various embodiments of the invention. The panel 5 is secured to the base 10 in the panel slot 30 by insert 20 and fastened by screws 25. The base features stand blocks 15 secured by screws 25 acting as a grip to secure the debris barrier 50 to the side of the pool.

Figure 5:
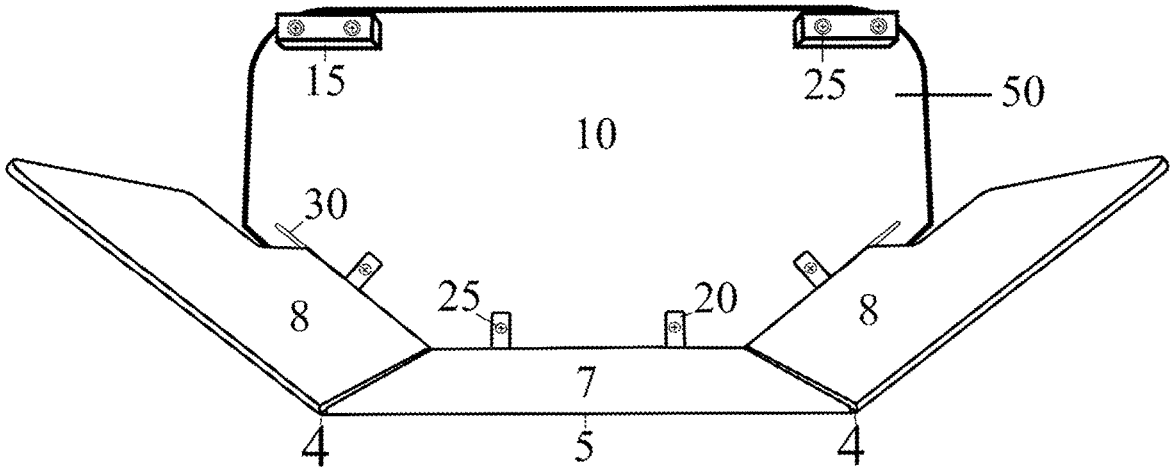
FIG. 5 is a bottom view of the debris barrier according to various embodiments of the present invention.
Figure 5A:
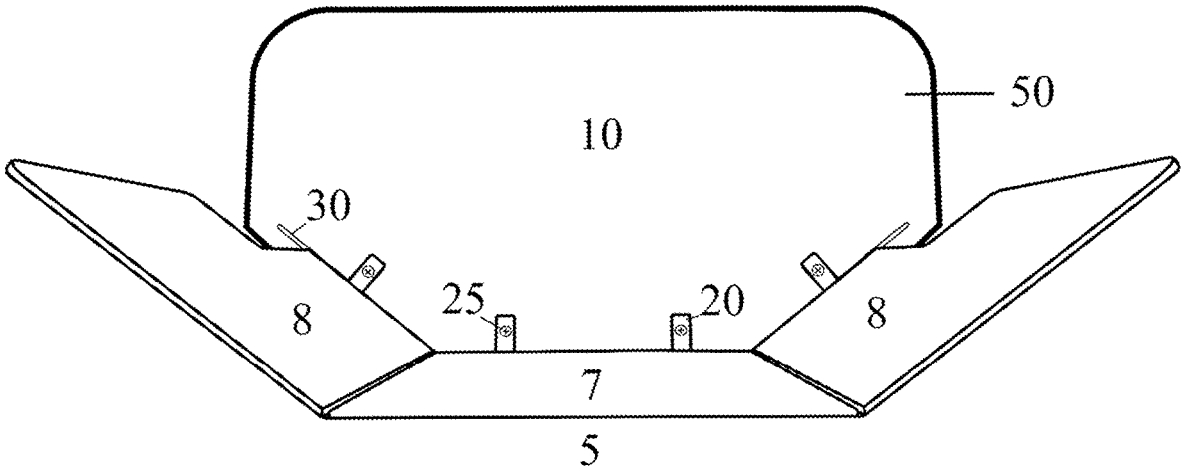
FIG. 5A is a bottom view of the debris barrier without the optional stand blocks according to various embodiments of the present invention.

FIG. 5 is a bottom view of the debris barrier 50 according to various embodiments of the present invention. The base 10 features stand blocks 15 secured by screws 25 to the back/rear end of the base 10. The panel 5 includes a front panel 7 and side panels 8, formed into the panel slot 30 by folding the panel bends 4. The side panels 8 are angled to encompass the water filtration system and block debris from entering. The front end of the base 10 features a panel slot 30 which fits the panel 5 with inserts 20 fitted into holes in the panel 5. Screws 25 are threaded through the insert 20 into the base 10.

Figure 6:
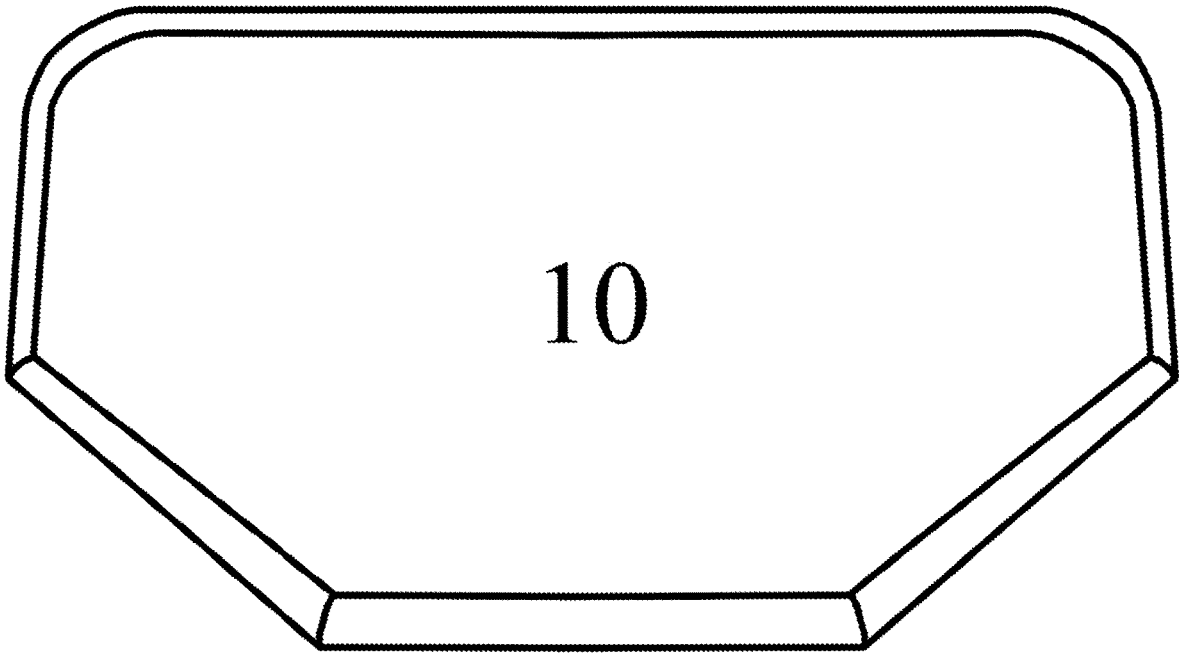
FIG. 6 is a top view of the debris barrier according to various embodiments of the present invention.

FIG. 6 is a top view of the debris barrier 50 according to various embodiments of the present invention. The base 10 has a straight edge on the back end supported by stand blocks 15 and an angled front end to match the curvature of the panel 5.

FIG. 7 is a bottom view of the base 10 according to various embodiments of the invention. The base 10 has a straight edge on the back end supported by stand blocks 15 attached by screws 25 and an angled front end to match the curvature of the panel 5. The panel 5 fits into the panel slot 30 on the underside of the angled front end of the base 10. The panel slot 30 features a central slot between two angled side slots parallel to edges of the base 10. The panel slot 30 features insert slots 21 for the inserts 20 to be placed into to secure the panel 5 into the panel slot 30 through the tabbed extensions of panel holes 9 using screws 25 to secure the inserts into the base 10.

FIG. 7A is a close-up view of the panel slot 30 according to various embodiments. The panel slot 30 features a central slot between two angled side slots parallel to edges of the base 10. The panel slot 30 is angled for the panel 5 to be placed into the panel slot 30 to enclose the swimming pool circulation system. Panel 5 is formed to the panel slot 30 by folding the panel bend 4 between the front panel 7 and side panels 8. The panel 5 is secured into the panel slot 30 with inserts 20 placed into the insert slots 21 which are secured to the base 10 with screws 25 and placed through the panel holes 9 while the panel 5 is in panel slot 30.

FIG. 8 is a top view of the panel 5 according to various embodiments of the present invention. The panel 5 is made up of a front panel 7 and side panels 8 separated by a panel bend 4. The panels feature panel holes 9 for the inserts 20 to be threaded through and attached to the base 10. The panel 5 features a thinner section of material between the front panel 7 and side panels 8 so that the panel 5 can be formed into the angles of the panel slot 30.

FIG. 8A is a close-up view of a panel bend 4 area in between the front panel 7 and a side panel 8. The panel bend 4 area is thinner than the width of the font panel 7 and side panel 8 so the panel 5 can fold and form to the panel slot 30. The panel 5 is secured to the panel slot 30 with secured inserts 20 threaded through the panel hole 9.

FIG. 9 is an orthogonal view of an insert 20 and screw 25 used to secure the panel 5 to the panel slot 30 in the base 10. The panel 5 is placed into the panel slot 30 and the insert 20 fits in the insert slot 21 and placed through the panel hole 9 and secured to the base with the screw 25 threaded through the hole in the insert 20.

A legend of the components discussed in the application and shown in the drawings is as follows:

Panel bend 4,
Panel 5,
Front panel 7,
Side panel 8,
Panel holes 9,
Base 10,
Stand blocks 15,
Insert 20,
Insert slot 21,
Screw 25,
Panel slot 30
Indention 40
Debris barrier 50

The invention claimed is:

1. A portable barrier apparatus mounted on a pool deck near a pool water inlet to prevent leaves and debris from entering a pool filtration system, comprising:

a) a base, further comprising top and bottom sides, a central front side, a first angled side, a second angled side, and a back side, the bottom side further comprising a central slot parallel to the central front side, a first side slot parallel to the first angled side and forming an oblique angle with the central slot, a second side slot parallel to the second angled side and forming an oblique angle with the central slot;

b) a front panel comprising a top edge, a bottom edge, and two side edges, the top edge fitting into the central slot of the base, c) a first side panel comprising at least a top edge, an interior side edge, a bottom edge, and an exterior side edge, the interior side edge connected to one of the two side edges of the front panel and the top edge fitting into a first angled slot in the base;

d) a second side panel comprising at least a top edge, an interior side edge, a bottom edge, and an exterior side edge, the interior side edge connected to the second of the two side edges of the front panel and the top edge fitting into the second of the two angled slots in the base;

e) a barrier formed by the front panel and the two side panels that extends from the bottom of the base into the pool into the surface of the pool's water.

2. A portable barrier apparatus as in claim 1, further comprising the side panels as formed with an indention in the exterior side edge.

3. A portable barrier apparatus as in claim 1, additionally comprising at least one grip affixed on the bottom of the base.

4. A portable barrier apparatus as in claim 1, additionally comprising a section of flat material partitioned into three sections by use of two perforated straight lines in the material, the three sections therein forming the front panel and two side panels by folding the section along the perforated straight lines, the angled set of panels fitting into the slots of the bottom of the base.

5. A portable barrier apparatus as in claim 4, the section of flat partitioned material comprising tabbed extensions at the top of each panel, the extensions secured to the base, fastening the panels in place in the slots.

6. A portable barrier apparatus as in claim 1, in which the panels are secured in the slots by L-shaped inserts, the inserts fastening to the panel and the base by screws.

* * * * *